US006623052B2

(12) United States Patent
Hansen

(10) Patent No.: US 6,623,052 B2
(45) Date of Patent: Sep. 23, 2003

(54) ADJUSTABLE ACTUATOR ASSEMBLY AND HANDLE ASSEMBLY HAVING ADJUSTABLE ACTUATOR ASSEMBLY

(76) Inventor: Randall C. Hansen, 6 Old Mill Ct., Columbia, SC (US) 29206

( * ) Notice: Subject to any disclaimer, the term of this patent is extended or adjusted under 35 U.S.C. 154(b) by 0 days.

(21) Appl. No.: 10/025,883

(22) Filed: Dec. 19, 2001

(65) Prior Publication Data

US 2003/0111848 A1 Jun. 19, 2003

(51) Int. Cl.[7] ..... E05B 3/00

(52) U.S. Cl. ..... 292/336.3; 292/DIG. 54; 292/DIG. 60; 292/DIG. 68; 70/208; 70/210

(58) Field of Search ..... 292/336.3, DIG. 60, 292/DIG. 68, DIG. 54; 70/208, 210, 461, 77

(56) References Cited

U.S. PATENT DOCUMENTS

| | | | | |
|---|---|---|---|---|
| 3,080,743 A | * | 3/1963 | Stansberry | 70/208 |
| 3,938,839 A | * | 2/1976 | Collier | 292/258 |
| 4,312,205 A | | 1/1982 | Reed et al. | |
| 4,321,812 A | | 3/1982 | Pelcin | |
| 4,487,440 A | | 12/1984 | Beijer | |
| 4,492,394 A | | 1/1985 | Dignan | |
| 4,623,177 A | * | 11/1986 | McKinney | 292/87 |
| 4,632,438 A | * | 12/1986 | McKinney | 292/87 |
| 4,671,547 A | | 6/1987 | Weinerman et al. | |
| 4,706,478 A | | 11/1987 | Swan et al. | |
| 4,989,907 A | | 2/1991 | Edmonds et al. | |
| 5,015,019 A | * | 5/1991 | Razdolsky | 292/200 |
| 5,063,764 A | | 11/1991 | Amis et al. | |
| 5,246,054 A | | 9/1993 | Shepherd et al. | |
| 5,377,450 A | | 1/1995 | Varajon | |
| 5,526,660 A | | 6/1996 | Bennett et al. | |
| 5,878,606 A | | 3/1999 | Chaput et al. | |
| 5,913,908 A | * | 6/1999 | Czipri | 70/208 |
| 5,984,383 A | | 11/1999 | Parikh et al. | |
| 6,418,761 B1 | * | 7/2002 | Wytcherley et al. | 70/208 |

FOREIGN PATENT DOCUMENTS

DE 3720790 A1 * 10/1988

OTHER PUBLICATIONS

Hansen Commercial & Industrial Hardware Catalogue, pp. 21, 22, and 23.

* cited by examiner

*Primary Examiner*—J. J. Swann
*Assistant Examiner*—Carlos Lugo
(74) *Attorney, Agent, or Firm*—Dority & Manning, P.A.

(57) ABSTRACT

A handle assembly is provided. The handle assembly includes a tray that has opposite sides and a shaft that is rotatable relative to the tray. Also included is a handle that is connected to the shaft. The handle rotates with the shaft relative to the tray, and is on one side of the tray with the shaft extending from an opposite side of the tray. A support member is connected to the shaft, and has a support arm on one end. An adjustable actuator is variably positionable on the support arm. The adjustable actuator has a latching mechanism, and is adjustable along the support arm to define a first range of adjustment of the latching mechanism. The adjustable actuator is reversible on the support arm to define a second range of adjustment of the latching mechanism.

33 Claims, 6 Drawing Sheets

ADJUSTABLE ACTUATOR ASSEMBLY AND HANDLE ASSEMBLY HAVING ADJUSTABLE ACTUATOR ASSEMBLY

TECHNICAL FIELD

This invention generally relates to an adjustable actuator assembly for a handle assembly and a related handle assembly including same. More particularly, this invention relates to an adjustable actuator assembly for a rotatable handle assembly such as a folding T-handle, and to a related handle assembly.

BACKGROUND

Door knobs and latch handles are well known in the prior art for providing a mechanism by which a user can open or close a door or cabinet. Typically, a door knob or latch handle is provided with a handle that can be rotated by the user. A support member is generally provided, being attached to the door knob or latch handle. This support member has a latching mechanism attached to the end that rotates into or out of an opening in a door jamb. In addition to doors, door knobs and latches can also be used in opening cabinets, drawers, or for other similar applications.

The door knob or latch handle needs to be connected to the cabinet or door. Also, the latching arm on the support member needs to be positioned so that it will enter an opening in the door jamb or wall. When engaged in this opening, pulling on the door handle will not open the cabinet or door because the latch will catch on the door jamb and prevent motion. When the latching arm is swung out from this opening, nothing impedes its motion and the door can be freely swung or slid into the open position.

Door knobs and latch handles can also be attached to a linkage which serves as a latch. This type of arrangement is sometimes used in a roll up door that is located on the back of a van or truck. Turning of the latch handles moves the latch out of an area in the side wall of the truck and allows the roll up door to be slid open.

T-handle, D-handle, or paddle door latches are typically employed on emergency vehicles such as fire engines and ambulances due to their relatively simple but reliable mechanisms, and their attractive appearance and aerodynamic shape. These door latches have the handle positioned inside of a recess in the surface of the vehicle. A user will generally rotate the handle in one plane so that it is no longer positioned inside of the recess. Next, the user will rotate the handle in a perpendicular plane that will result in the door being opened.

A door latch which is representative of the prior art is a locking folding "T" handle door latch produced by Hansen International of Columbia, S.C. This door latch consists of a T-shaped handle which is positioned inside of a recess in a tray. The user rotates out the T-handle for activation of the door, which is accomplished by then rotating the T-handle either clockwise or counterclockwise. The T-handle is attached to a shaft which rotates relative to the tray. A support member is attached to the shaft and therefore rotates along with the T-handle. An actuator is slideably engaged to a slot along one side of the support member.

The actuator includes an extending latch mechanism which is swung into a recess in a door jamb when the T-handle is rotated. The door is prevented from being opened when the latch mechanism is located inside of the door jamb. The actuator is adjustable in order to properly align the latch mechanism to the recess in the door jamb, or to whatever other means is being used to prevent the door from being opened. However, this adjustment is limited to the length of the slot in the support member.

Another door latch, which is also representative of the prior art, is disclosed in U.S. Pat. No. 4,989,907 (Edmonds et al.). The paddle handle employed in this invention is housed inside of a recess in a tray. The user inserts his or her fingers inside the recess and pulls up on the paddle handle, causing it to rotate. A strut is connected to the paddle handle and interacts with a catch. The catch in turn interacts with a striker which can be inserted or removed from a door jamb or latch to open or close the door. When the paddle handle is not rotated by the user, a spring biases the catch into position.

Although the '907 patent provides for an effective latch mechanism, it does not provide a door latch which can be adjusted to vary the distance of the latching arc to the plane of the tray. One invention which provides a one way adjustment of a door handle assembly is shown in U.S. Pat. No. 5,377,450 issued to Varajon. In the '450 patent, a door handle for a vehicle is provided. The door handle is composed of a trim latch and an interior latch. To compensate for the variations in assembly of an automobile door, the '450 patent provides for a series of plastic ratchet fasteners. These rachet fasteners are located on a set of mounting ears which protrude from the trim latch assembly. The assembly holding the trim latch is connected to the automobile. The assembly holding the interior latch is adjusted on the rachet fasteners so that the interior latch assembly is properly positioned. The plastic rachet fasteners allow adjustment in one direction only because the fins on the fasteners prevent any reverse motion.

The '450 patent allows for the door handle assembly to be adjustably mounted on the door inner panel and the door trim panel. However, the connection to the door latch is not adjustable by the rachet fasteners. Since this latching mechanism cannot be adjusted, the '450 patent does not provide a way of adjusting the plane of the latching arc relative to the plane of a tray or frame.

The prior art thus includes different door knobs and latch handles which are used to move a latching mechanism into or out of a space in a door jamb, or to effectuate motion of a linkage. Although these devices provide a means of allowing a door to be opened and closed, these devices do not include a latching mechanism which can be adjusted by the user to fit several different door jambs and linkages, or which is capable of adjustment at a range greater than just the length of the slot in the support arm of the support member.

SUMMARY

Objects and advantages of the invention will be set forth in part in the following description, or may be obvious from the description, or may be learned through practice of the invention.

According to certain aspects of the invention, a handle assembly is provided. The handle assembly is comprised of a tray which has opposite sides. A shaft is also provided, and it is made to be rotatable with respect to the tray. A handle is connected to this shaft, and provides a means by which a user or machine can grasp the handle to turn the shaft. The handle is on one side of the tray, and the shaft extends from an opposite side of the tray. The handle is made to rotate the shaft. The shaft is connected to a support member. The support member has a support arm located on one end. An adjustable actuator is variably positioned to this support arm. The adjustable actuator has a latching mechanism. The adjustable actuator is adjustable along the support arm to define a first range of adjustment of the latching mechanism. The adjustable actuator is reversible on the support arm to define a second range of adjustment of the latching mechanism.

Also according to other aspects of the invention, a folding handle assembly having an adjustable actuator is provided. This assembly comprises a tray which has a perimeter flange and which defines a recess internal of the flange. The tray has a planar face on one side. Also, a shaft is provided that is rotatable relative to the tray. A pin is disposed through this shaft. A handle is rotatably connected to the shaft by the pin. The handle is capable of being positioned inside of the recess of the tray. A support member is connected to the shaft so as to rotate with the shaft. The support member has a support arm on one end. Also, an adjustable actuator is variably positioned on the support arm of the support member. The adjustable actuator has a latching mechanism. The adjustable actuator is adjustable along the support arm to define a first range of adjustment of the latching mechanism. The adjustable actuator is reversible on the support arm to define a second range of adjustment of the latching mechanism.

Also according to another embodiment of the invention, an adjustable actuator assembly for attachment to a rotatable shaft of a handle assembly is provided. The actuator assembly includes a support member that is connected to the shaft and is rotatable with the shaft. The support member has a support arm on one end. Also, an adjustable actuator is variably positionable on the support arm of the support member. The adjustable actuator has a latching mechanism, and is adjustable along the support arm to define a first range of adjustment of the latching mechanism. The adjustable actuator is also reversible on the support arm to define a second range of adjustment of the latching mechanism.

Another aspect of the present invention includes one of the above-mentioned embodiments where the first range of adjustment of the latching mechanism is opposite in direction to the second range of adjustment of the latching mechanism.

A further embodiment of the present invention includes a handle assembly as mentioned above which further includes a bolt for fastening the adjustable actuator to the support arm of the support member. Here, the support arm of the support member and the adjustable actuator have an opening to receive the bolt. A further aspect of the present invention includes such a configuration where one of the openings is a slot and the other of the openings is a hole.

A further embodiment of the invention may include a handle assembly as mentioned above which further includes a set of support arm teeth located on the support arm of the support member. Also included is a set of actuator teeth located on the adjustable actuator. The actuator teeth and the support arm teeth interlock with one another.

A further aspect of the invention may include an adjustable actuator assembly as mentioned above where the latching mechanism has a curved surface. Further, the present invention may include an embodiment where the latching mechanism has a generally round outer surface.

DETAILED DESCRIPTION

Figure 1:
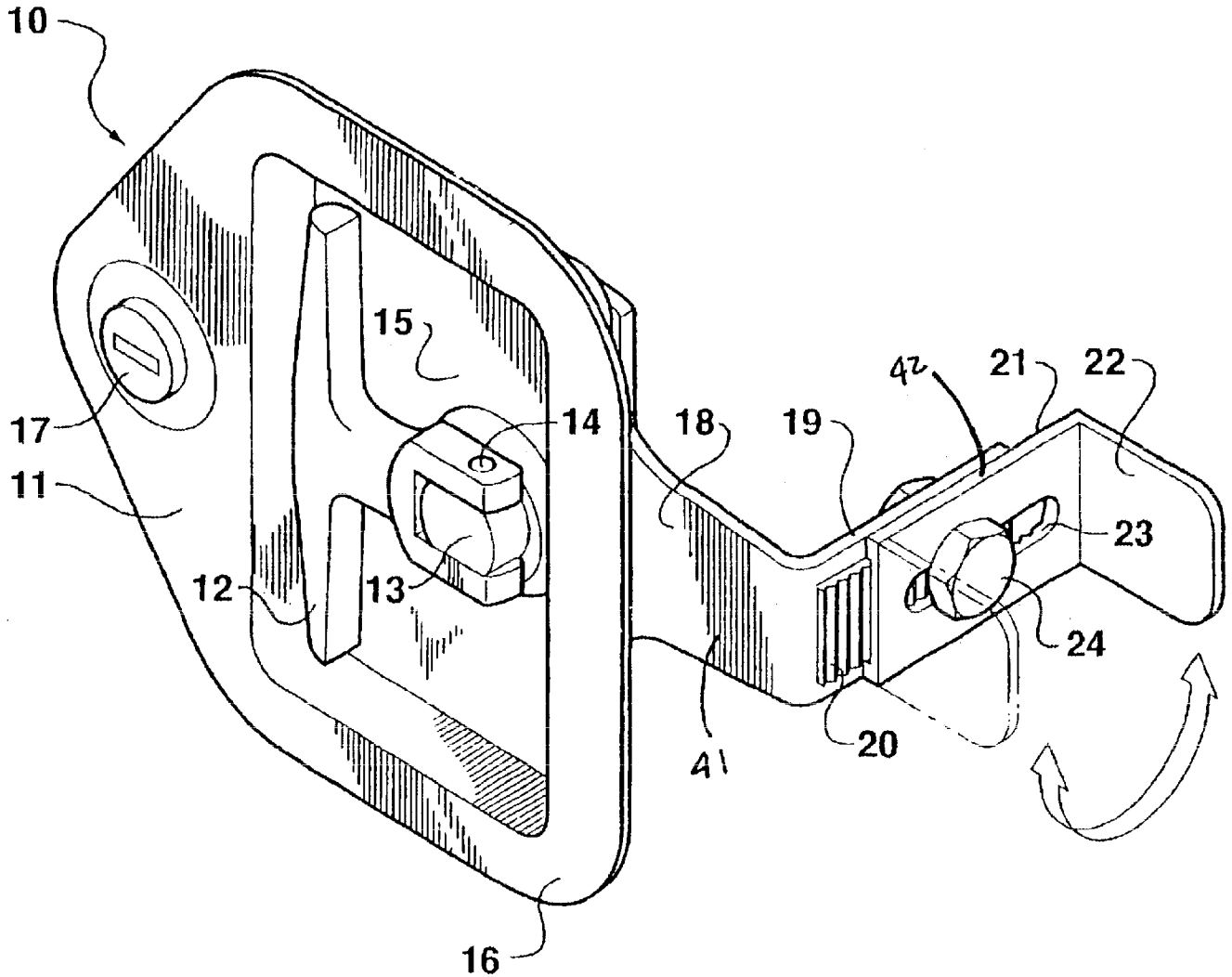
FIG. 1 is an isometric view of one embodiment of an adjustable actuator assembly and rotatable handle assembly according to certain aspects of the present invention. The drawing shows how the adjustable actuator assembly can be rotated 180° on the support arm of the handle assembly.

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention include such modifications and variations.

Referring now to the drawings, FIG. 1 shows a latch handle for use in opening a door or cabinet in accordance with the present invention, indicated generally at 10. The latch handle includes a tray 11, sometimes referred to in the art as a frame. Tray 11 includes a recess 15 which is surrounded on its outer perimeter by a flange 16. Tray 11 is generally placed inside an opening in a door, vehicle, or cabinet. Flange 16 is either flush with the surface the tray 11 is attached to, or flange 16 lies just on top of this surface. Such a tray 11 is often used in many applications due to its attractive, modular appearance.

Inside of recess 15, a handle 12 is housed. Handle 12 is connected to a shaft 13 via a pin 14. This pinned connection allows handle 12 to be rotated about pin 14 relative to shaft 13. Shaft 13 is capable of rotating, which in turn allows handle 12 to also rotate due to its pinned connection to shaft 13.

As shown in FIG. 1, handle 12 is not being used by a person to open or close a door. When latch handle 10 is being used, a person will rotate handle 12 about pin 14 to get handle 12 in an upright position. A person will then rotate handle 12 to effect a rotation of shaft 13. Upon completion of the opening or closing of the door, a person will generally move handle 12 back into the position shown in FIG. 1. Such a storage position allows for an aerodynamic and attractive appearance of latch handle 10, along with avoiding the possibility of catching one's body or clothing on a protruding handle 12.

It is to be understood, however, that handle 12 may be one of several different types known in the prior art, and not just the embodiment shown in FIG. 1. For example, handle 12 could be a round handle with a flange on the base, such as is commonly used as automobile gas caps. Additionally, handle 12 could be a "D" shaped handle, an extending "L"

or other curved shaped handle. Thus, rotatable handles of different configurations are to be considered within the scope of this invention.

Shaft 13 extends through tray 11 in a manner known in the art. An adjustable actuator assembly is connected to shaft 13 via a shaft hole 25 (see FIG. 3). The adjustable actuator assembly includes a support member 18 and an adjustable actuator 21. Support member 18 is provided with a support arm 19 on one end. In one embodiment, support arm 19 is substantially perpendicular to a body portion 41 of support member 18. Support arm teeth 20 run along the length of one side of support arm 19. Adjustable actuator 21 is attached to support arm 19, and has teeth 31 that mate with teeth 20 of support arm 19 in multiple orientations. Adjustable actuator 21 has a body portion 42, and adjustable actuator 21 has a latching mechanism 22 located on one end. In one embodiment, the latching mechanism 22 is substantially perpendicular to the body portion 42 of the adjustable actuator 21.

Support member 18 typically has a shaft hole 25 used in securing shaft 13. Support member 18 also make use of a first plunger opening 26 and a second plunger opening 27 with a space 28 in between. These two openings are used to lock support member 18 into place by a slidable plunger (not shown) mounted to the rear of the tray 11 and controlled by a key locking mechanism 17. Consequentially, locking of support member 18 will cause the door or cabinet to be held in an opened or closed position because latching mechanism 22 will also be prevented from being moved.

Adjustable actuator 21 can be made of the same material as is support arm 19 and/or support member 18, or can be made of different material. Both options are within the scope of the invention.

Figure 2:
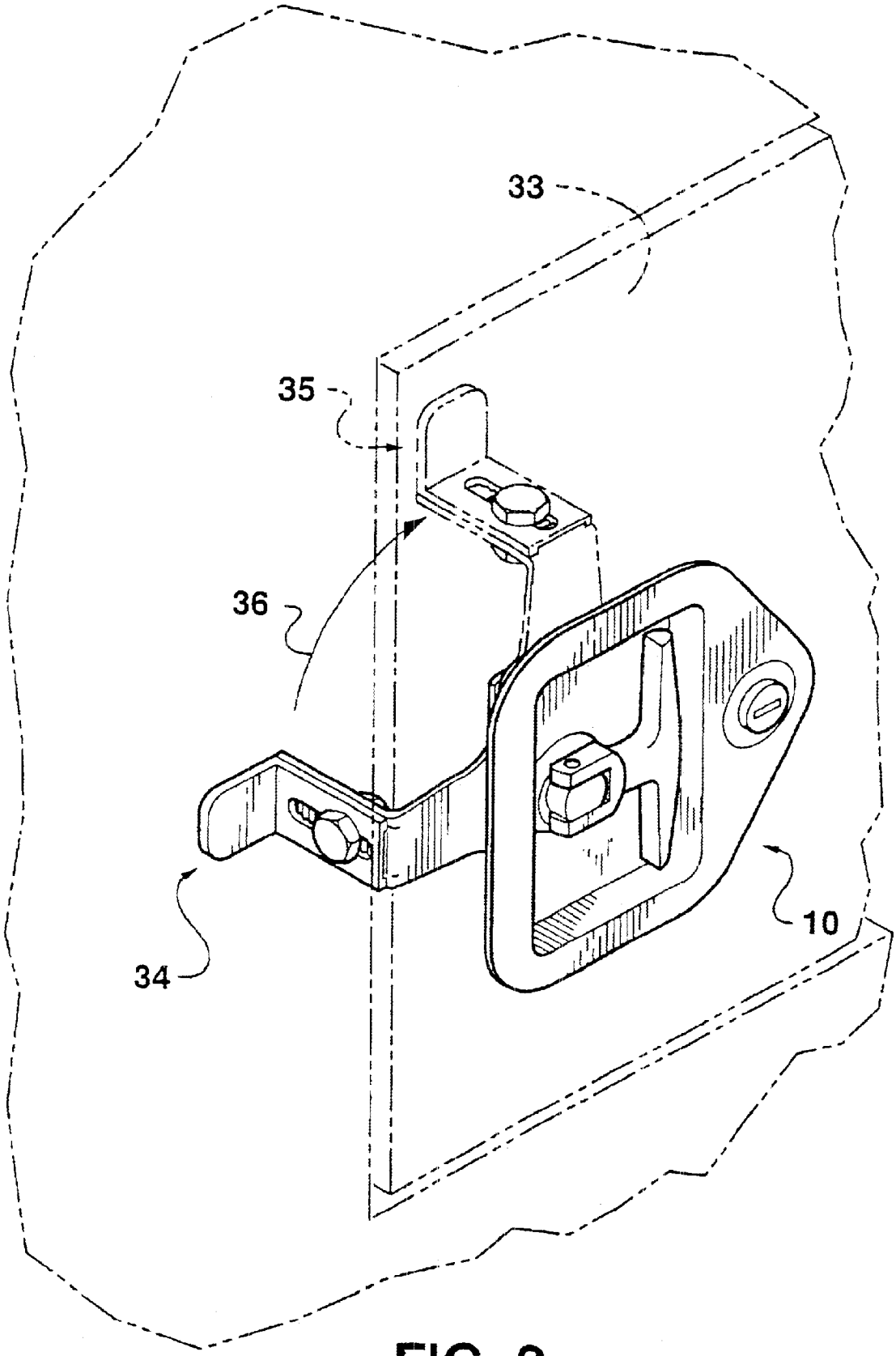
FIG. 2 is an isometric view of the device of FIG. 1. The drawing shows a typical open and closed position of the adjustable actuator assembly.

FIG. 2 shows the latch handle 10 of the present invention as it is employed on a wall, door, or other surface 33. A possible closed position 34 is shown along with a possible open position 35 of latching mechanism 22. To get from an opened to a closed position, the latching mechanism 22 must travel along a latching arc 36. Such a latching arc 36 is generally 90° in arc length in most applications. However, an arc length of up to 360° is sometimes needed in an application, and any such arc is to be considered within the scope of the invention.

Figure 3:
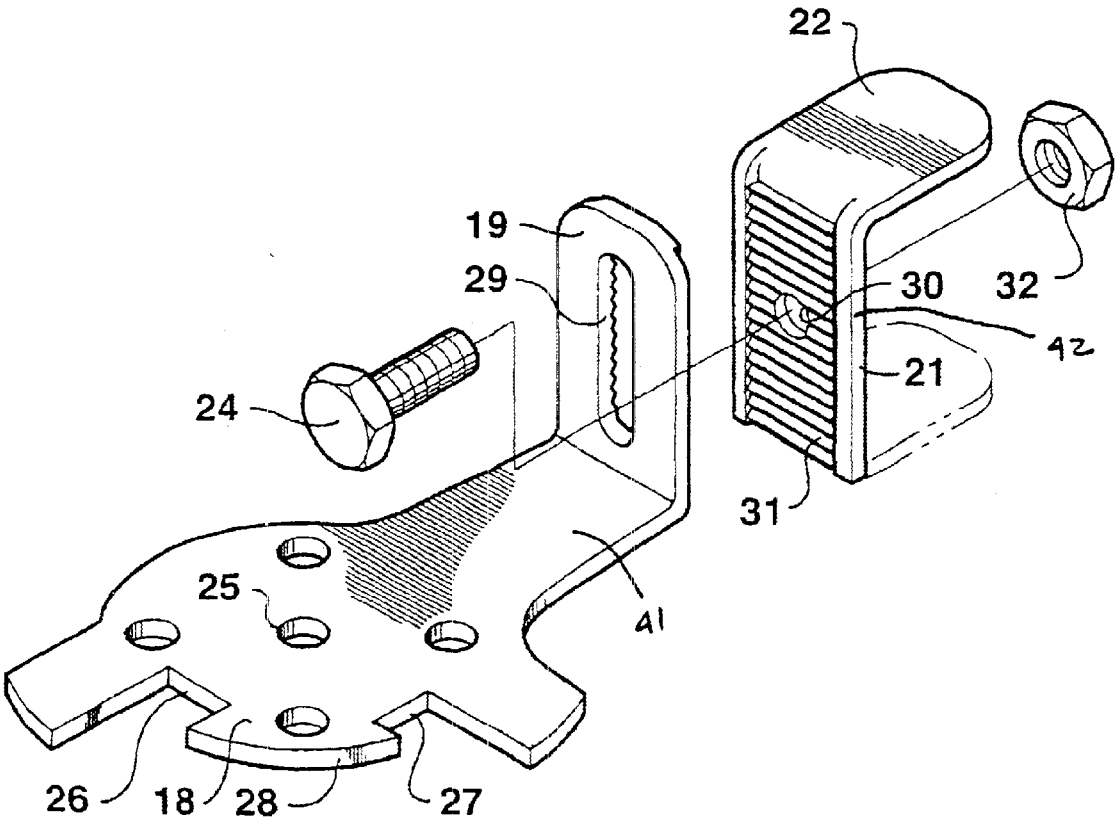
FIG. 3 is an isometric view showing the adjustable actuator assembly of FIG. 1. The drawing also shows how the connection between the adjustable actuator and the support member is facilitated by use of a bolt and nut.

The connection between support arm 19 and adjustable actuator 21 is shown in more detail in FIG. 3. As shown, adjustable actuator 21 has a series of actuator teeth 31 running along the length of one side of adjustable actuator 21. Upon engagement with the support arm 19, actuator teeth 31 interlock with the support arm teeth 20. This interlocking provides for a stronger connection between support arm 19 and adjustable actuator 21 than if no teeth were present. The teeth provide resistance against torsional forces on the connection, and resistance against forces acting along the length of adjustable actuator 21 and support arm 19.

Support arm teeth 20 and actuator teeth 31 and/or adjustable actuator 21 can be made of the same or different material. Both options are considered to be within the scope of the present invention.

The connection of the adjustable actuator 21 itself is effectuated by a nut 32 and bolt 24 arrangement. A slot 29 is located substantially along the length of support arm 19. A hole 30 in adjustable actuator 21 is positioned along the length of this slot 29, and then bolt 24 is disposed through slot 29 and hole 30. Nut 32 secures the bolt 24, and effects the connection between support arm 19 and adjustable actuator 21 to thereby create the adjustable actuator assembly.

Figure 4:
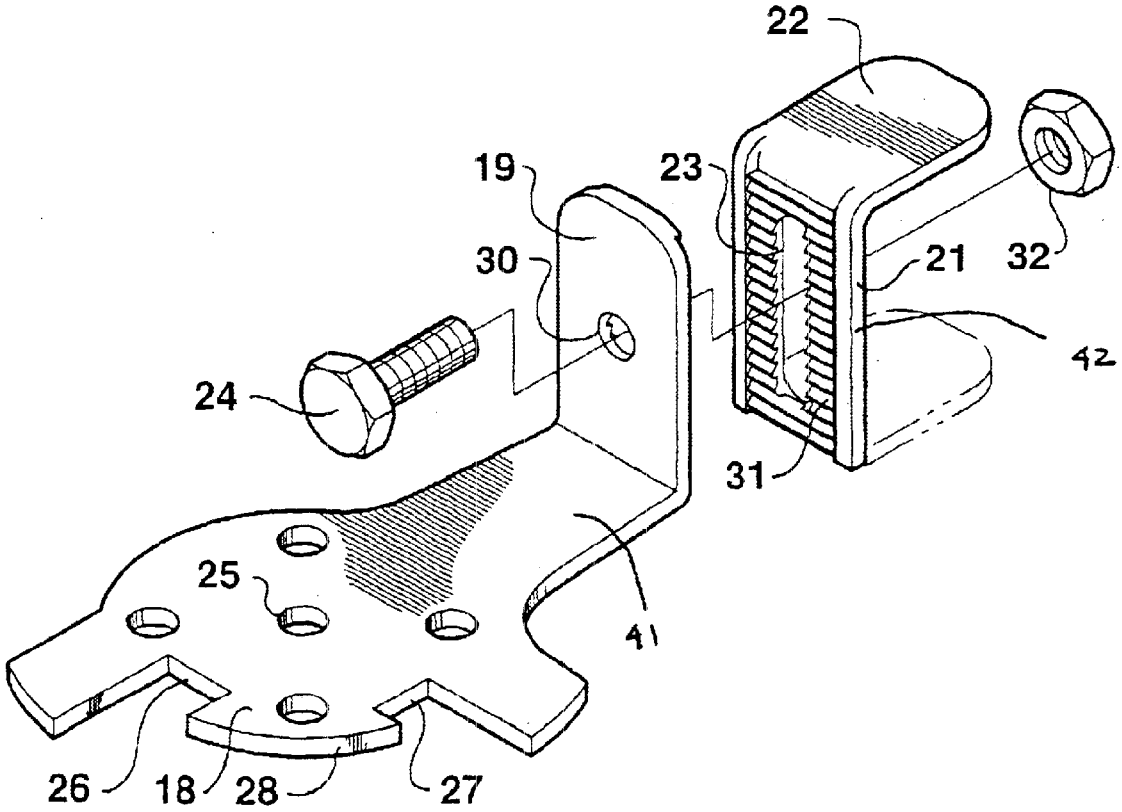
FIG. 4 is an isometric view showing a modified adjustable actuator assembly. The drawing shows an arrangement similar to FIG. 3, only with the slot connection being reversed between the support member and the adjustable actuator.

This connection is shown in an alternate embodiment in FIG. 4. Here, the slot 23 is disposed substantially along the length of adjustable actuator 21. Hole 30 is placed in support arm 19. Hole 30 can be positioned along the length of slot 23, and then bolt 24 and nut 32 can be used to effect a connection between support arm 19 and adjustable actuator 21.

The latching mechanism 22 protrudes from one end of adjustable actuator 21. Latching mechanism 22 defines a latching arc 36 (see FIG. 2) when the latch handle 10 is activated. Turning of handle 12 effects a rotation of shaft 13 which in turn rotates latching mechanism 22 due to the rigid connection between latching mechanism 22 and the shaft 13. Generally, latching mechanism 22 is rotated into a slot on a door jamb or frame member. In this position, the door cannot be opened because latching mechanism 22 makes contact with the door jamb and impedes movement of the door. When the latch handle 10 is turned, latching mechanism 22 moves out of the door jamb, and the door may be opened.

Latch handle 10 may be used in various applications. For instance, instead of doors, latch handle 10 can be used in cabinets, compartments on emergency vehicles, in roll up type doors, etc. Also, in addition to only interacting with a door jamb, latching mechanism 22 can be connected to any object which needs to be turned, or which when contacted can prevent a door from opening or closing. For instance, latching mechanism 22 can be connected to a linkage which in turn engages an opening in the side wall of a van. Such a situation could be present when it is desired to employ a latch handle to open a roll up type door. Turning handle 12 will effect a retracting of the linkage and allow for the door to be rolled up. In essence, many applications involving the need to rotate an object, or to define a latching arc 36 are present through the world, and the scope of the present invention is defined to cover them all.

Adjustable actuator 21 is adjustable in that one can adjust the position of adjustable actuator 21 along the length of support arm 19. Adjustment in this manner will necessarily cause an adjustment of latching mechanism 22 because latching mechanism 22 is rigidly connected to adjustable actuator 21. This allows for a first range of adjustment to be defined by latching mechanism 22. The range of adjustment of adjustable actuator 21 is limited only to the length of slot 29.

In addition, adjustable actuator 21 is constructed so that it may be rotated 180° on support arm 19. Such a rotation is shown in phantom on FIG. 3 and 4. In addition, this rotation is shown in phantom on FIG. 1 and also indicated by the two arrows pointing to the latching mechanism 22. Allowing for the adjustable actuator 21 to be rotated 180° effectively doubles the range of adjustment of latching mechanism 22. Reversibility therefore allows one to move latching mechanism 22 along a second range of adjustment.

Figure 5:
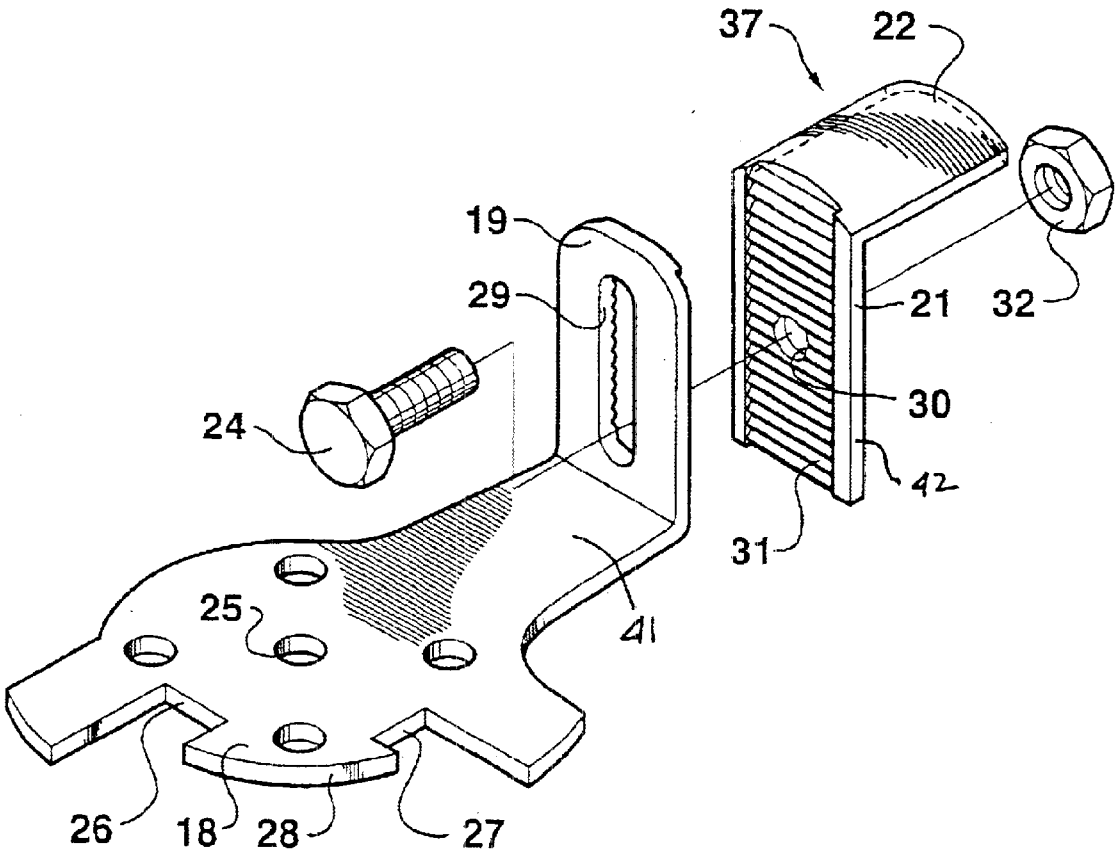
FIG. 5 is an isometric view showing another modified adjustable actuator assembly. The drawing differs from FIG. 3 in that the latching mechanism has a curved surface for slamming purposes.

The configuration of the actuator assembly can be altered in order to more advantageously suit the desired application. For instance, as shown in FIG. 5, it may be advantageous to make latching mechanism 22 have a curved surface 37 to prevent or aid in slamming of a door. The curved surface 37 allows for smoother contact between the latching mechanism 22 and a door jamb as the door is closed.

Figure 6:
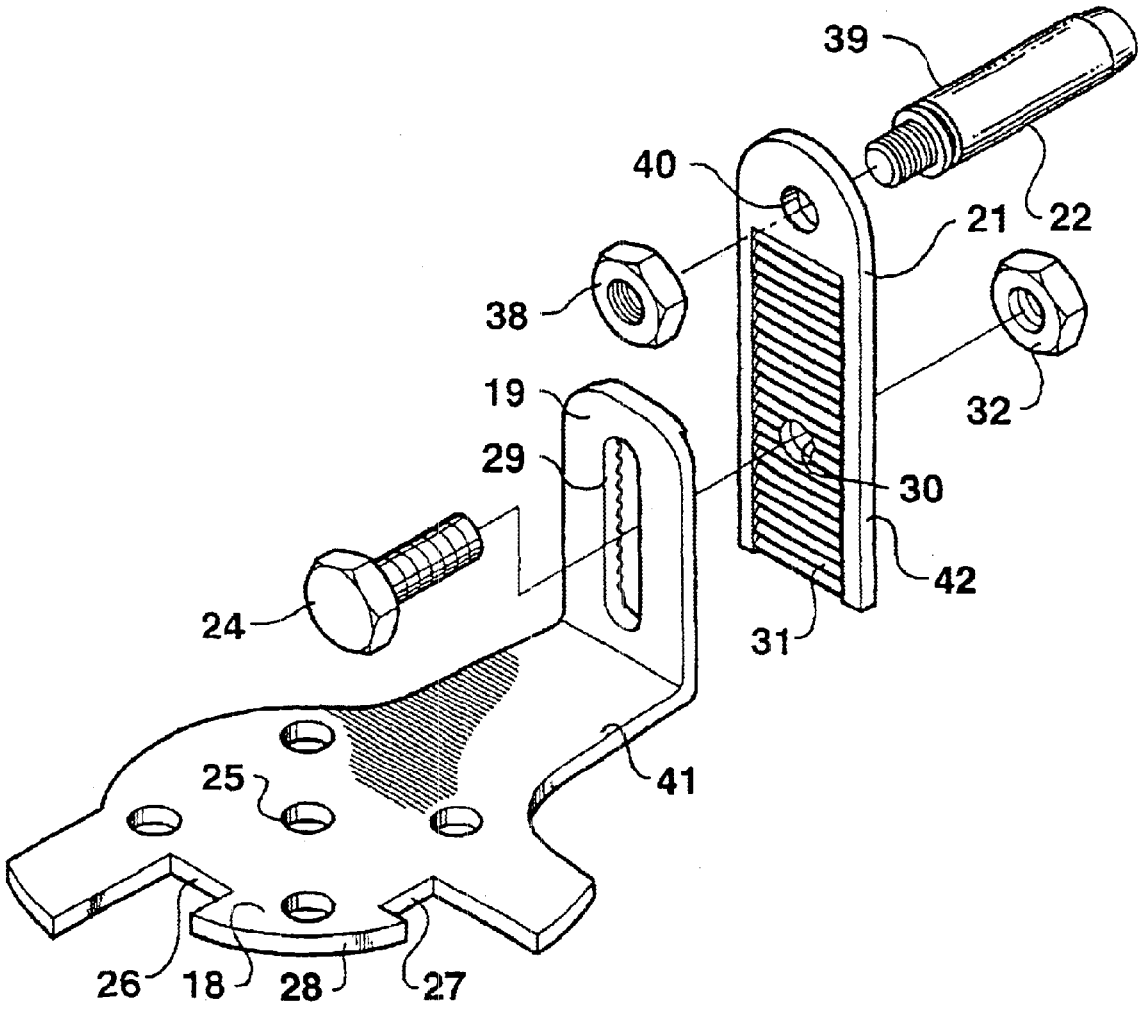
FIG. 6 is an isometric view showing another modified adjustable actuator assembly. The drawing differs from FIG. 3 in that the latching mechanism has a radius.

In addition, latching mechanism 22 can be a member having a round surface 39 as shown in FIG. 6. Such a member may be attached to adjustable actuator 21 by a nut 38. The end of latching mechanism 22 having a round surface 39 is threaded to effect attachment with the nut 38 onto adjustable actuator 21. A hole 40 is disposed through adjustable actuator 21 to facilitate this attachment. Round surface 39 allows for a smoother engagement with a door jamb or other structure.

In addition to these configurations of latching mechanism 22, other configurations can be used in the present invention. For instance, the round surface 39 described in the embodiment of FIG. 6 could be disposed on an annular member that rotates freely relative to adjustable actuator 21. Various configurations of latching mechanisms 22 and attachments to adjustable actuator 21 are thus to be considered within the scope of the present invention.

Configurations of the connection between adjustable actuator 21 and support arm 19 can be varied in arrangement, and all are to be considered to fall under the scope of this invention. For instance, as indicated in FIGS. 1 and 4, the slot 29 may be included on adjustable actuator 21 instead of support arm 19. In addition, the hole 30 may be placed on support arm 19 instead of adjustable actuator 21. Also, the slot/hole arrangement may be replaced with two slots. Further, the arrangement could consist of a series of holes on one piece with a singe hole on another. Brackets, clamps, set screws, or any other connection known in the prior art could also be used to effect an adjustable connection between the adjustable actuator 21 and the support arm 19.

The adjustment of the adjustable actuator assembly provides for an adjustment of the plane of the latching arc 36 relative to the plane of tray 11. This adjustment is desirable for a number of reasons. First, it may be the case that due to dimensional variations, an adjustment is necessary to properly align the latching arc 36 to the hole in the door jamb. Also, one could provide for an adjustable actuator assembly to be incorporated into a number of different applications with the use of a standard latch handle 10. Such would be advantageous in no longer requiring a different sized latch handle 10, or actuator assembly, or both, to be constructed to fit every different sized application.

It will be appreciated that various modifications and changes may be made to the above described preferred embodiment of a folding handle latch having an adjustable actuator without departing from the scope of the following claims.

I claim:

1. A handle assembly comprising:

(a) a tray having a perimeter flange and defining a recess internal of said flange, said tray having a planar face on one side of said tray;

(b) a shaft rotatable relative to said tray;

(c) a pin disposed through said shaft;

(d) a handle being rotatably connected to said shaft by said pin, said handle capable of being positioned inside of said recess of said tray;

(e) a support member connected to said shaft so as to rotate with said shaft, said support member having a support arm on one end thereof; and (f) an adjustable actuator variably positionable on said support arm of said support member, said adjustable actuator having a latching mechanism, said adjustable actuator being adjustable along said support arm to define a first range of adjustment of said latching mechanism, and said adjustable actuator being reversible on said support arm to define a second range of adjustment of said latching mechanism.

2. The handle assembly of claim 1 wherein said first range of adjustment of said latching mechanism is opposite in direction to said second range of adjustment of said latching mechanism.

3. The handle assembly of claim 1 further comprising a bolt for fastening said adjustable actuator to said support arm of said support member, wherein said support arm of said support member has an opening to receive said bolt, and wherein said adjustable actuator has an opening to receive said bolt.

4. The handle assembly of claim 3 wherein one of said openings is a slot and the other of said openings is a hole.

5. The handle assembly of claim 4 further comprising a nut engaging said bolt.

6. The handle assembly of claim 1 further comprising:

(a) a set of support arm teeth located on said support arm of said support member; and (b) a set of actuator teeth located on said adjustable actuator, said actuator teeth and said support arm teeth interlocking with one another.

7. The handle assembly of claim 1 wherein said latching mechanism is generally rectangular in shape.

8. The handle assembly of claim 1 wherein said support member has a first plunger opening and said support member has a second plunger opening spaced from said first plunger opening, and said support member defines a shaft hole to accept said shaft.

9. The handle assembly of claim 1 wherein said latching mechanism has a curved surface.

10. The handle assembly of claim 1 wherein said latching mechanism has a generally round outer surface.

11. The handle assembly of claim 1 wherein the support arm is substantially perpendicular to a body portion of the support member.

12. The handle assembly of claim 1 wherein the latching mechanism is substantially perpendicular to a body portion of the adjustable actuator.

13. A handle assembly comprising:

(a) a tray having opposite sides;

(b) a shaft rotatable relative to said tray;

(c) a handle connected to said shaft, so as to rotate said shaft relative to said tray, said handle being on one side of said tray and said shaft extending from an opposite side of said tray;

(d) a support member connected to said shaft, said support member having a support arm on one end of said support member; and (e) an adjustable actuator variably positionable on said support arm, said adjustable actuator having a latching mechanism, said adjustable actuator being adjustable along said support arm to define a first range of adjustment of said latching mechanism, and said adjustable actuator being reversible on said support arm to define a second range of adjustment of said latching mechanism.

14. The handle assembly of claim 13 wherein said first range of adjustment of said latching mechanism is opposite in direction to said second range of adjustment of said latching mechanism.

15. The handle assembly of claim 13 further comprising a bolt for fastening said adjustable actuator to said support arm of said support member, wherein said support arm of said support member has an opening to receive said bolt, and wherein said adjustable actuator having an opening to receive said bolt.

16. The handle assembly of claim 15 wherein one of said openings is a slot, and the other of said openings is a hole.

17. The handle assembly of claim 16 further comprising a nut engaging said bolt.

18. The handle assembly of claim 13 further comprising:

(a) a set of support arm teeth located on said support arm of said support member; and (b) a set of actuator teeth located on said adjustable actuator, said actuator teeth and said support arm teeth interlocking with one another.

19. The handle assembly of claim 13 wherein said latching mechanism is generally rectangular in shape.

20. The handle assembly of claim 13 wherein said support member has a first plunger opening and said support member has a second plunger opening spaced from said first plunger opening, and said support member defines a shaft hole to accept said shaft.

21. The handle assembly of claim 13 wherein said latching mechanism has a curved surface.

22. The handle assembly of claim 13 wherein said latching mechanism has a generally round outer surface.

23. An adjustable actuator assembly for attachment to a rotatable shaft of a handle assembly, comprising:

a support member connected to the shaft and rotatable with the shaft, said support member having a support arm on one end thereof; and an adjustable actuator variably positionable on said support arm of said support member, said adjustable actuator having a latching mechanism, said adjustable actuator being adjustable along said support arm to define a first range of adjustment of said latching mechanism, and said adjustable actuator being reversible on said support arm to define a second range of adjustment of said latching mechanism.

24. The adjustable actuator assembly of claim 23 wherein said first range of adjustment of said latching mechanism is opposite in direction to said second range of adjustment of said latching mechanism.

25. The adjustable actuator assembly of claim 23 further comprising a bolt for fastening said adjustable actuator to said support arm of said support member, wherein said support arm of said support member has an opening to receive said bolt, and wherein said adjustable actuator has an opening to receive said bolt.

26. The adjustable actuator assembly of claim 25 wherein one of said openings is a slot and the other of said openings is a hole.

27. The adjustable actuator assembly of claim 26 further comprising a nut engaging said bolt.

28. The adjustable actuator assembly of claim 23 further comprising:

a set of support arm teeth located on said support arm of said support member; and a set of actuator teeth located on said adjustable actuator, said actuator teeth and said support arm teeth interlocking with one another.

29. The adjustable actuator assembly of claim 23 wherein said latching mechanism is generally rectangular in shape.

30. The adjustable actuator assembly of claim 23 wherein the latching mechanism is substantially perpendicular to a body portion of the adjustable actuator.

31. The adjustable actuator assembly of claim 23 wherein said latching mechanism has a curved surface.

32. The adjustable actuator assembly of claim 23 wherein said latching mechanism has a generally round outer surface.

33. The adjustable actuator assembly of claim 23 wherein the support arm is substantially perpendicular to a body portion of the support member.

* * * * *